US010378329B2

(12) United States Patent
Boone

(10) Patent No.: US 10,378,329 B2
(45) Date of Patent: Aug. 13, 2019

(54) RIG CONTROL SYSTEM AND METHODS

(71) Applicant: Canrig Drilling Technology Ltd., Houston, TX (US)

(72) Inventor: Scott Gilbert Boone, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 854 days.

(21) Appl. No.: 13/971,501

(22) Filed: Aug. 20, 2013

(65) Prior Publication Data

US 2015/0053482 A1 Feb. 26, 2015

(51) Int. Cl.

| | |
|---|---|
| ***E21B 44/00*** | (2006.01) |
| ***E21B 41/00*** | (2006.01) |
| ***E21B 7/02*** | (2006.01) |
| *E21B 7/00* | (2006.01) |

(52) U.S. Cl.

CPC ..... *E21B 44/00* (2013.01); *E21B 7/022* (2013.01); *E21B 41/00* (2013.01); *E21B 41/0092* (2013.01); *E21B 7/00* (2013.01)

(58) Field of Classification Search

CPC . E21B 7/00; E21B 7/022; E21B 41/00; E21B 41/0092; E21B 2041/0035; E21B 44/00

See application file for complete search history.

(56) References Cited

U.S. PATENT DOCUMENTS

| | | | |
|---|---|---|---|
| 4,839,853 A | 6/1989 | Deerwester et al. | |
| 5,301,109 A | 4/1994 | Landauer et al. | |
| 6,480,118 B1 | 11/2002 | Rao | |
| 6,980,940 B1 | 12/2005 | Gurpinar et al. | |
| 7,003,439 B2 | 2/2006 | Aldred et al. | |
| 7,020,597 B2 | 3/2006 | Oliver et al. | |
| 8,210,283 B1 * | 7/2012 | Benson | E21B 7/04 175/26 |
| 8,386,059 B2 | 2/2013 | Boone | |
| 2002/0026456 A1 | 2/2002 | Bradford | |
| 2004/0182606 A1 | 9/2004 | Goldman et al. | |
| 2005/0096846 A1 | 5/2005 | Koithan et al. | |
| 2005/0149307 A1 | 7/2005 | Gurpinar et al. | |

(Continued)

FOREIGN PATENT DOCUMENTS

WO WO 2008/140939 A1 11/2008

OTHER PUBLICATIONS

PCT, "International Search Report," re PCT/US2014/047887, dated Nov. 21, 2014.

(Continued)

*Primary Examiner* — D. Andrews

*Assistant Examiner* — Tara E Schimpf

(74) *Attorney, Agent, or Firm* — Haynes and Boone, LLP

(57) ABSTRACT

Apparatus, systems, and methods for controlling activities on a drilling rig are described. The methods include installing a control system operably coupled to the drilling rig and having a user interface, receiving operational guidelines from the user interface that include a plurality of control limits associated with operational parameters of the rig, monitoring current values of the operational parameters, and automatically applying the control limits to the operational parameters during operation of the rig.

18 Claims, 4 Drawing Sheets

(56) References Cited

U.S. PATENT DOCUMENTS

| | | | | |
|---|---|---|---|---|
| 2005/0171698 | A1 | 8/2005 | Sung et al. | |
| 2005/0209866 | A1 | 9/2005 | Veeningen et al. | |
| 2006/0181742 | A1 | 8/2006 | Lech et al. | |
| 2006/0185899 | A1 | 8/2006 | Alft et al. | |
| 2008/0065362 | A1 | 3/2008 | Lee et al. | |
| 2008/0173480 | A1* | 7/2008 | Annaiyappa | E21B 15/00 175/24 |
| 2008/0179094 | A1 | 7/2008 | Repin et al. | |
| 2008/0275594 | A1 | 11/2008 | de Guzman | |
| 2008/0281525 | A1* | 11/2008 | Boone | E21B 44/00 702/9 |
| 2009/0090555 | A1* | 4/2009 | Boone | E21B 7/04 175/45 |
| 2011/0024187 | A1 | 2/2011 | Boone et al. | |
| 2011/0220410 | A1* | 9/2011 | Aldred | E21B 44/00 175/26 |
| 2013/0127900 | A1 | 5/2013 | Pena et al. | |
| 2013/0231787 | A1* | 9/2013 | Chapman | E21B 44/00 700/282 |
| 2014/0083688 | A1* | 3/2014 | Rojas | E21B 44/00 166/250.01 |

OTHER PUBLICATIONS

PCT, "Written Opinion of the International Searching Authority," re PCT/US2014/047887, dated Nov. 21, 2014.
U.S. Appl. No. 10/337,426, filed Jan. 7, 2003, Bradford.
U.S. Appl. No. 12/976,736, filed Dec. 22, 2010, Boone.

* cited by examiner

RIG CONTROL SYSTEM AND METHODS

TECHNICAL FIELD

The present disclosure relates to apparatus, systems, and methods for drilling management systems, and more particularly to automated systems and methods for controlling operations on a drilling rig.

BACKGROUND OF THE DISCLOSURE

A well prognosis, or a well program, referred to by people in the drilling industry as a "prog," or "well prog," is generally known to be a detailed document containing the information various experts contribute to plan for and chronicle the steps of drilling a well, which, in general includes all aspects surrounding the creation of an operational well, including planning, drilling, and completing. The prog is used by the operator's company representative, generally known as a company man, to ensure best-practices are used at every step and in every aspect of drilling the well.

Operators typically employ trained company men to enforce best practices on the drilling rig. They also hire driller coaches, have prespud meetings, and meet offsite to educate the crew on best practices. Operators and tool pushers also use other service providers to assist in the oversight of the rigs. For example, a good directional driller will frequently coach the driller on how to manage various hole conditions or drilling challenges. Systems and methods that automatically control and enforce best practices on a rig with less or no human intervention would be a valuable addition to the field.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
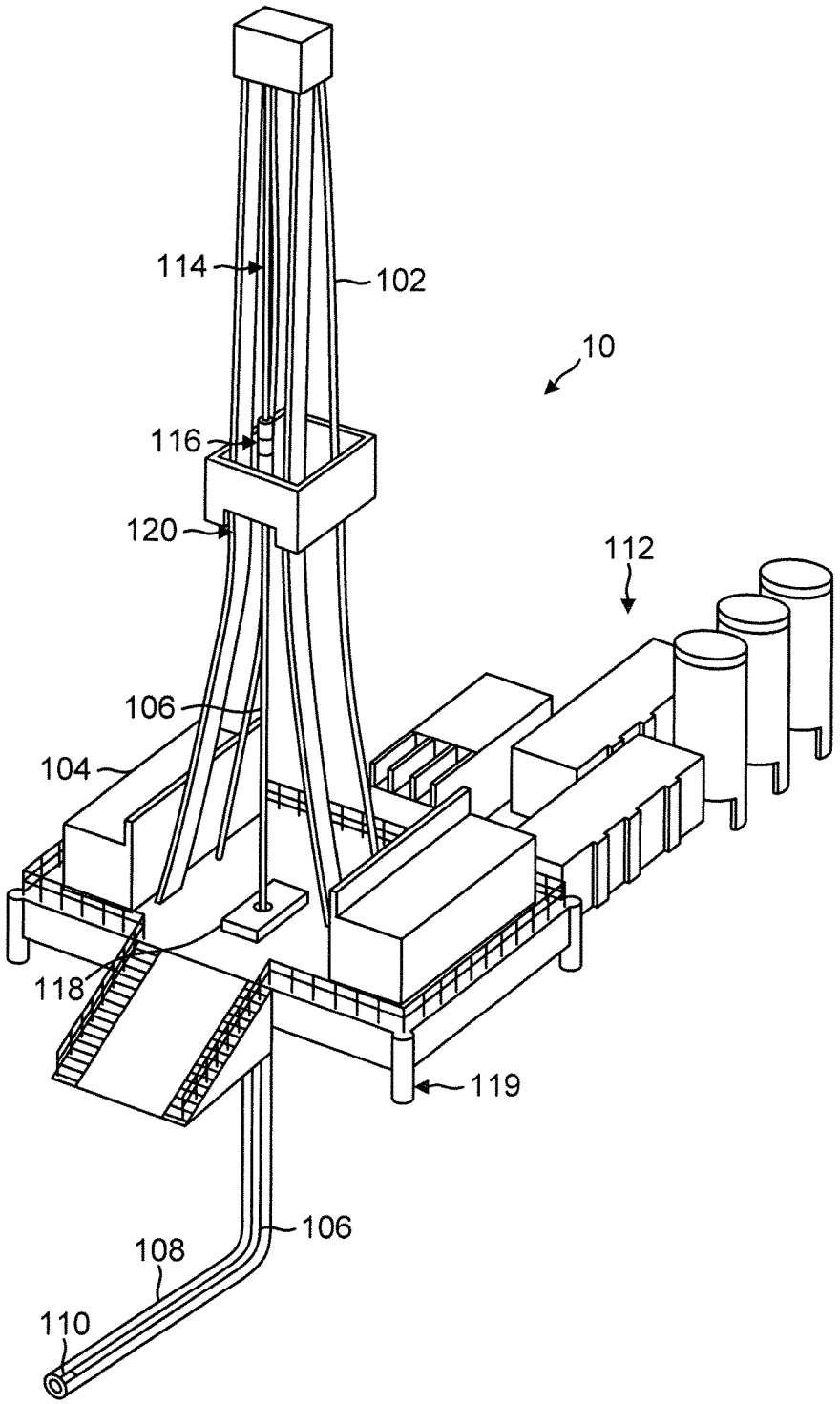
FIG. 1 is a diagram of a traditional drilling rig.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure provides systems and methods that control operations on a rig by setting automatic control limits for various rig activities at various times during the drilling of the well. For example, a rig may be capable of pulling pipe from the wellbore at 5 feet per second, but in some cases, hole conditions dictate that the pipe should not pulled in excess of 2 feet per second. In this case, the company man can de-rate the rig to operate at a slower speed than the operational limit. Various templates can be completed in advance to facilitate the workflow before operations begin for a given process or portion of the operations, such as for surface hole, intermediate hole, and production hole. Once the different operational guidelines ("recipes") are determined using the templates, the tool pusher enters these recipes into the rig control system and makes them available for use. When various hole sections (e.g., surface hole, intermediate hole, and production hole) are reached, or when a certain predefined event (e.g., circulate a kick or trip out of hole to change a bit) occurs, the appropriate recipes can be activated. In various embodiments, one or more of these recipes can be activated by the control system after it receives sensed information indicating that the predefined event has occurred or condition exists.

Further, at least one embodiment of the present disclosure is implemented as a program product for use with a computer system. The program product defines functions of the embodiments (including the methods) described herein and can be contained on a variety of computer readable media. Illustrative computer readable media include, without limitation, (i) information permanently stored on non-writable storage media (e.g., read-only memory devices within a computer such as CD-ROM disks readable by a CD-ROM drive); (ii) alterable information stored on writable storage media (e.g., floppy disks within a diskette drive or hard-disk drive, writable CD-ROM disks and DVD disks, zip disks, and portable memory devices); and (iii) information conveyed across communications media, (e.g., a computer, telephone, wired network, or wireless network). These embodiments can include information shared over the Internet or other computer networks. Such computer readable media, when carrying computer-readable instructions that perform methods of the invention, represent an exemplary embodiment of the invention.

Further still, in general, software routines implementing embodiments of the present disclosure may be part of an operating system or part of a specific application, component, program, module, object, or sequence of instructions, such as an executable script. Such software routines typically include a plurality of instructions capable of being performed using a computer system, programmable logic controller (PLC), programmable automation controller (PAC), or other type or processor configured to execute instructions read from a computer readable medium. Also, programs typically include or interface with variables, data structures, etc. that reside in a memory or on storage devices as part of their operation. In addition, various programs described herein may be identified based upon the application for which they are implemented. Those skilled in the art will readily recognize, however, that any particular nomenclature or specific application that follows facilitates a description of the invention and does not limit the invention for use solely with a specific application or nomenclature. Furthermore, the functionality of programs described herein may use a combination of discrete modules or components interacting with one another. Those skilled in the art will recognize, however, that different embodiments may combine or merge such components and modules in a variety of ways.

Referring first to FIG. 1, illustrated is a schematic view of an apparatus 10 demonstrating one or more aspects of the present disclosure. The apparatus 10 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

In the depicted embodiment, the apparatus is a typical oil and gas drilling rig 10 having a vertically erect derrick 102 for assembling, positioning, tripping and drilling with a drill string 106. The doghouse 104, adjacent to the derrick 102 provides a convenient location for the driller to coordinate drilling operations. From the doghouse 104, the driller can normally observe the entire rig, including the substructure 119 that supports the pipe handler assembly 114 and the derrick 102, that supports the automated tubular racking system 120, optional casing running system (not shown), and the top drive assembly 116, and the drill floor, that houses a floor wrench assembly 118, rotary table and, normally, a drawworks.

The mud system assembly 112 is shown to have mud pits and mud pumps, and further is operationally coupled to the derrick 102 to supply mud (i.e., drilling fluids) into the drill string 106. Mud pumps push the mud all the way through the drill string 106 to the drill bit 110 in various embodiments, where the mud lubricates the bit and flushes cuttings away. As more mud is pushed through the drill string 106, the mud fills the annulus around the drill string 106, inside the drill hole 108, and is pushed back to the surface. At the surface the mud system assembly 112 recovers the mud and separates out the cuttings and typically removes gas from the mud so the mud can be reused. The condition of the mud is assessed and additives are replenished as needed to achieve the necessary mud characteristics. Also, at the surface, in various embodiments the rig has a blow out prevention system to close in the well bore and protect the well site in the event of a kick, or loss of returns, and optionally, a choke manifold and control system to manage the over pressurized, balance pressured or under pressurized well bore fluid returns.

On a traditional rig, the systems described above are controlled primarily through experience and human perceptions, often with a human operating control switch or even instructing a computer to send a signal to start, stop, or change a given operating component or operational process. In the present disclosure, however, automated systems are available to substantially augment the skill of the drillers for many of the systems on the rig 10. Sensors and monitors required for the operation of each automated system may be added to the drill string 106, drill bit 110, mud system assembly 112, pipe handler assembly 114, drawworks, rotary table 118, top drive assembly 116, automated tubular racking system 120, casing running system, floor wrench assembly 118, blow out preventors and choke manifold systems and any other drilling equipment/system on site and in use, and any other wellsite component(s), with the data collected by the sensors and monitors, and this data is directed to the doghouse 102, or drillers cabin for the driller to review. The separate systems generate a substantial volume of data.

Figure 2:
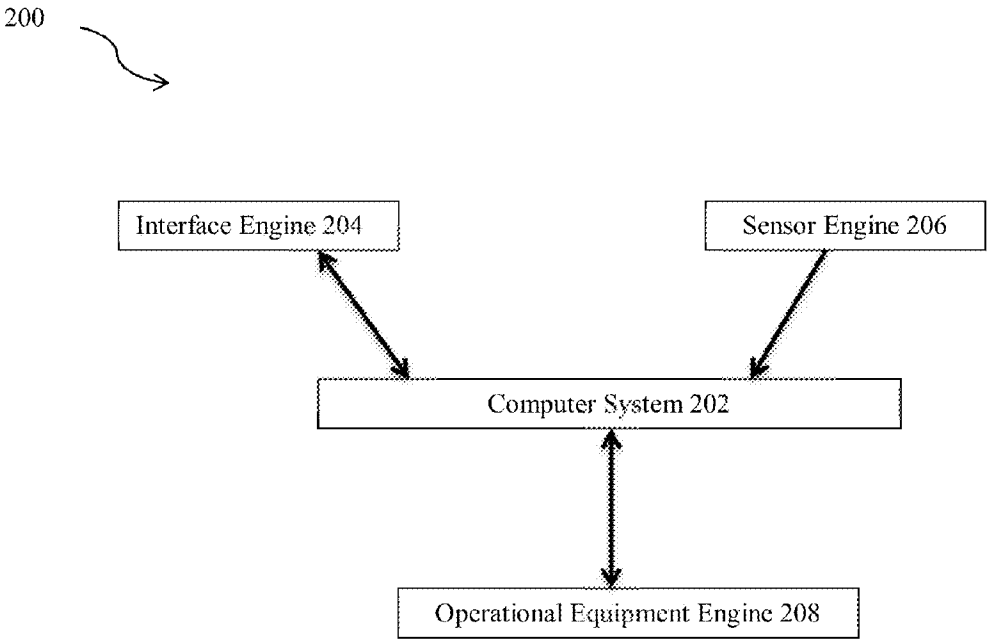
FIG. 2 is a block diagram of the control system according to one or more aspects of the present disclosure.

FIG. 2 illustrates an exemplary schematic diagram of the components of a rig control system 200 according to one or more aspects of the present disclosure. The exemplary rig control system 200 includes a computer system 202 coupled to an interface engine 204, a sensor engine 206, and an operational equipment engine 208. The term "engine(s)" is meant herein to refer to an agent, instrument, or combination of either, or both, agents and instruments that may be associated to serve a purpose or accomplish a task. Agents and instruments may include sensors, actuators, switches, relays, valves, power plants, system wiring, equipment linkages, specialized operational equipment, computers, components of computers, programmable logic devices, microprocessors, software, software routines, software modules, communication equipment, networks, network services, and other elements and their equivalents which contribute to the purpose or task to be accomplished by the engine.

The interface engine 204 includes at least one input and output device and system that enables an operator or operators to interact with the computer system 102 and the functions that the computer system 202 provides. An exemplary interface engine 204 may have multiple user stations, which may include a video display, a keyboard, a pointing device, a document scanning/recognition device, or other device configured to receive an input from an external source, which may be connected to a software process operating as part of a computer or local area network. The exemplary interface engine 204 may include externally positioned equipment configured to input data (such as operational parameters of a well prog) into the computer system 202. Data entry may be accomplished through various forms, including raw data entry, data transfer, or document scanning coupled with a character recognition process, for example.

The interface engine 204 may include a user station that has a display with touch-screen functionality, so that a driller or operator may receive information from the system 200, and provide input to the system 200 directly via the display or touch screen. Other examples of sub-components that may be part of an interface engine 204 include, but are not limited to, audible alarms, visual alerts, telecommunications equipment, and computer-related components, peripherals, and systems. Sub-components of the interface engine 204 may be positioned in various locations within an area of operation, such as on a drilling rig at a drill site. Sub-components of the interface engine 204 may also be remotely located away from the general area of operation, for example, at a business office, at a sub-contractor's office, in an operations manager's mobile phone, and in a sub-contractor's communication linked personal data appliance. A wide variety of technologies would be suitable for providing coupling of various sub-components of the interface engine 204 and the interface engine 204 itself to the computer system 202. In some embodiments, the operator may thus be remote from the interface engine 204, such as through a wireless or wired internet connection, or a portion of the interface engine 204 may be remote from the rig, or even the wellsite, and be proximate a remote operator, and the portion thus connected through, e.g., an internet connection, to the remainder of the on-site interface engine 204 components.

The sensor engine 206 may include one or more sensing devices, such as sensors, meters, detectors, or other devices, configured to measure or sense a parameter related to a prog specification or a component of a well drilling operation. The sensors or other detection devices are generally configured to sense or detect activity, conditions, and circumstances in an area to which the device has access. These sensors can be located on the surface or downhole, and information transmitted to the surface through a variety of methods. Sub-components of the sensor engine 206 may be deployed at any operational area where information on the execution of the prog may occur. Readings from the sensor engine 206 are fed back to the computer system 202. The reported data may include the sensed data, or may be derived, calculated, or inferred from sensed data. Sensed data may be that concurrently collected, recently collected, or historically collected, at that wellsite or an adjacent wellsite.

The computer system 202 receives and processes data from the sensor engine 206 or from other suitable source(s), and monitors the rig 10 and conditions on the rig 10 based on the received data. The computer system 202 may send signals to the sensor engine 206 to adjust the calibration or operational parameters in accordance with a control program in the computer system 202, which is generally based upon the prog. Additionally, the computer system 202 may generate outputs that control the well drilling operation. The computer system 202 compares each operational parameter to a dynamic allowable range for the parameter. The allowable range is based on the control limits, but can be changed.

The operational equipment engine 208 may include a plurality of devices configured to facilitate accomplishment of the objectives set forth in the prog. In an exemplary embodiment, the objective is to drill a well in accordance with the specifications set forth in the prog. Therefore, the operational equipment engine 208 may include hydraulic rams, rotary drives, valves, solenoids, agitators, drives for motors and pumps, control systems, and any other tools, machines, equipment, etc. that would be required to drill the well in accordance with the prog. The operational equipment engine 208 may be designed to exchange communication with computer system 202, so as to not only receive instructions, but to provide information on the operation of operational equipment engine 208 apart from any associated sensor engine 206. For example, encoders associated with a top drive may provide rotational information regarding a drill string, and hydraulic links may provide height, positional information, or a change in height or positional information. The operational equipment engine 208 may be configured to receive control inputs from the computer system 202 and to control the well drilling operation (the components conducting the well drilling operation) in accordance with the received inputs from the computer system 202.

The computer system 202, interface engine 204, sensor engine 206, and operational equipment engine 208 should be fully integrated with the recipes to assure proper operation and safety. Moreover, measurements of the rig operating parameters (block position, hookload, pump pressure, slips set, etc.) should have a high level of accuracy to enable proper accomplishment of the recipes with minimal or no human intervention once the operational parameters are selected and the control limits are set for a given drilling recipe, and the trigger(s) are pre-set to initiate the recipe.

Figure 3:
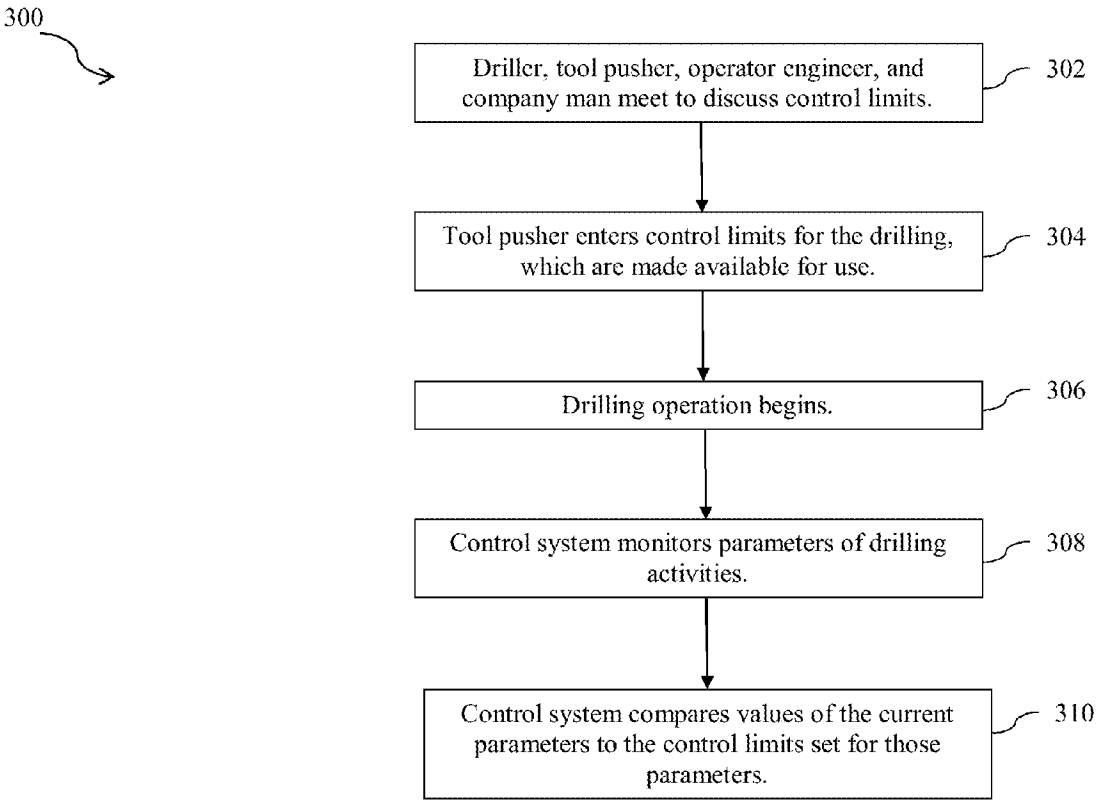
FIG. 3 is a flowchart that illustrates a method of controlling a rig according to one or more aspects of the present disclosure.

Turning now to FIG. 3, an exemplary rig control process 300 is illustrated. The process 300 starts with a meeting between the driller, tool pusher, operator engineer, and the company man at step 302. The well prog should be fully defined by the operator and include sufficient details to enable proper set up of the different drilling recipes for the well stages.

In this embodiment, the meeting starts with a set of paper templates of control limits that can be set for various rig activities at various times during the drilling of the well. The various templates can then be used to complete recipes, for example, for the surface hole, the intermediate hole, and the production hole. As another example, a recipe can be prepared for one or more complex or specific geological layers through which the drilling is expected to proceed. The completed paper templates become the control document for setting the control limits of the drilling rig and can include sign-off, dates and times of creation, and dates and times of implementing, within the control system. Any suitable method for documenting the requirements for the recipes may be used. For example, the recipes can be recorded using an electronic form with a signature pad, an audio recorder, a video recorder, etc. When the various hole sections are reached, or when a certain defined event occurs, the appropriate recipe can be activated. Some very simple wells may have a company man that sets no limits to the rig and instructs the crew to operate the equipment at its operational limits. When this is the case, the recipe is set to have control limits at the maximum limits, or operational limits.

An exemplary drilling project execution prog is formulated, and the tool pusher (or another data entry user) enters the control limits of different parameters for each recipe into the computer system 202 at step 304, through interface engine 204. These recipes are made available for use.

Interface engine 204 may include equipment and systems that support a variety of prog data entry methods. Entering the operational limits may be accomplished by a selected manner or combination of manners, which include copying a text data file into the computer system 202, scanning a document into the computer system 202 and conducting a character recognition process on the document, responding to an interview (e.g., a knowledge engineering system) that asks pertinent questions about the full range of potential operations the prog may cover, or incorporating the prog or elements of the prog into the computer system 202 by any other method of transferring text from a hard copy document into a machine readable format. In another embodiment, the prog may be developed electronically in which case no transferring is required.

Typical activities that will be described in a project execution prog include any activity understood to one of ordinary skill in the art to relate to execution of the project (drilling the well). In a drilling operation, such activities may include, without limitation, one or more of operational instructions (including limits or allowable ranges) based on well depth, spud details, such as the drive pipe depth, cementing details, running surface pipe, including order the pipe, ordering the cement, and testing the shoe, intermediate casing completion, liner run, reaching total depth, including logs to run, notifications to make, well log samples to deliver, information of interest about the formation, including depths for expected overpressure and depletion, disaster plans, logging run notifications, sample distributions lists, other well control procedures, directional programs, and expected days versus depth data.

At step 306, the drilling operation begins. At step 308, as the drilling progresses, the computer system 102 monitors the different activities on the rig and the parameters associated with those activities. The sensor engine 206 and operational equipment engine 208 send current data to the computer system 202.

At step 310, the computer system 202 compares the values of current parameters to the control limits previously set for those parameters to ensure that the drilling equipment does not go over or under the limit or the allowable range. The computer system 202 controls the operational equipment engine 208 to ensure that it operates only within the set control limits, or within a range of limits, without concurrent external input from an operator or driller (i.e., the operator or driller input occurs before the recipe is implemented, and preferably, without any input or modification once implementation begins).

In various embodiments, the control limits for the parameters may be changed at the interface engine 204. That is, the limits are dynamic. Drillers should be trained to assure timely overrides of automatic operations of a recipe when unexpected well conditions are encountered that require intervention, such as dangerous or safety-related conditions.

In an exemplary embodiment, the rig control system supports at least fifteen (15) recipes or operational guidelines to drill, each recipe pertaining to a different process or event during drilling, or to a specific hole section. In various embodiments, the recipes may be prenamed. For example, the recipes may be prenamed "Drill Surface," "Drill Intermediate," "Drill Production Hole," "Circulate Kick," "Run Casing Intermediate," "Run Casing Production," "Ream Hole," "Surface Hole," "Intermediate Hole," or "Production Hole." The name for the recipe should be descriptive of the process or section of the hole. In one embodiment, a limited number of recipes are predefined to simplify administration of the system.

There are major components in most recipes that generally relate to the equipment or higher level process i.e.: (1) the drawworks recipes, (2) the on-bottom recipes, (3) the pump recipes, (4) the top drive/directional drilling recipes, etc. Each component includes a variety of operational parameters associated with each recipe component. In various embodiments, all four of these components are present in a given recipe.

Figure 4:
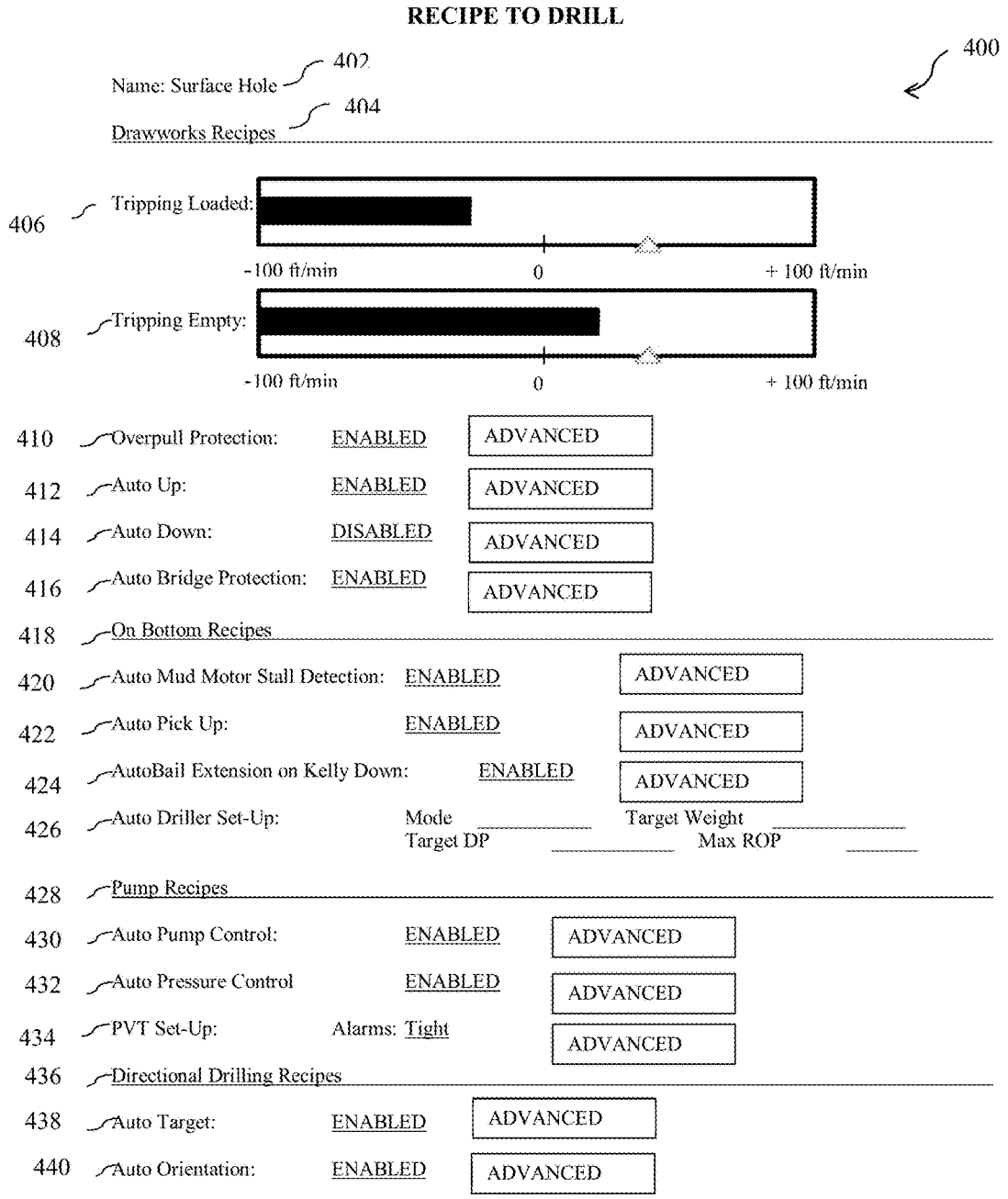
FIG. 4 is a screen shot of a user interface according to one or more aspects of the present disclosure.

An exemplary screen shot 400 of a "recipe to drill screen" that may be displayed to a driller is shown in FIG. 4, which illustrates the plurality of operational parameters, limits, and activities that may be contained in a prog. The recipe to drill screen is managed by the tool pusher with direct input from the company man, and provides a way to enforce best practices on the rig, particularly during drilling operations.

In various embodiments, the screen has the ability to lock configurations with a password. In some embodiments, the company man is able to see the recipes on the screen at any time from his office computer or other display device remote from the wellsite. The screen should display at least the rig's operational limits and the current operating parameters being executed upon by that recipe. In some embodiments, the screen has a pre-set configuration for ease of use so that all operational limits and operating parameters are shown, although some may be zeroed out if not in use for a given recipe.

Turning back to FIG. 4, shown is the header or name 402 of the recipe "Surface Hole," which describes the specific hole section. The header functions to identify the recipe to drill. In one embodiment, the header also includes the date it was last modified, and also has a field that indicates if the recipe is active or inactive. Typically, only one recipe can be active at a time, but multiple recipes could be enabled as long as the control points in the recipes are not contradictory. For example, one recipe could be designed for directional drilling and another for drilling surface hole. Both could be enabled as long as no control points in one affect the control points in the other. The control system alerts the rig's operators (driller, tool pusher, etc.) when recipes are changed to ensure that the operational limits and configuration of the system have been changed.

Below the header is the screen body, which includes a variety of operational parameters associated with each recipe component. The parameters can generally be enabled or disabled. If enabled, the exact settings can be set by accessing an "Advanced" pop-up box.

One component of most recipes is the drawworks recipe 404. Drawworks recipes can include one or more of the operational parameters of Maximum Running Speed Up or Down with Hook Load 406, Maximum Running Speed Up or Down with No Hook Load 408, Overpull Protection 410, Automatic Up 412, Automatic Down 414, and Automatic Bridge Protection 416. In various embodiments, each of these operational parameters is available for control by the recipe. Maximum Running Speed Up or Down with Hook Load is a parameter that measures the maximum allowable running speed up or down in feet per second or feet per minute for the rig with a load that exceeds the weight of the blocks, top drive, and about 10,000 pounds. Maximum Running Speed Up or Down with No Hook Load is a parameter that measures the maximum allowable running speed up or down in feet per second or feet per minutes for the rig with a load that is less than the weight of the blocks, top drive, and about 10,000 pounds. In each case, the control limit can be set less than the maximum operational running speed. The recipe can alert the crew if the speed limit is achieved, and each parameter can be turned on or off with a checkbox. Each parameter is also managed using a bar graph or other graphical tool that illustrates quantity from zero (0) to the maximum operational running speed. As seen in FIG. 4, the bar graph shows the current value of the parameter, the scale (−100 ft/min to 100 ft/min) shows the operational limits of the rig, and the triangle shows the control limit provided by the company man.

Monitoring the Overpull Protection parameter 410 prevents the rig crew from damaging the pipe by pulling too hard. This parameter measures the static weight of the string and prevents the driller from pulling more than the static weight plus an "overpull" amount. In an exemplary embodiment, the recipe includes an entry field for the overpull amount and other related parameters in an "Advanced" pop-up box, along with a check box to enable it.

Monitoring the Automatic Up 412 and Automatic Down 414 parameters enable the control system to move the drillstring upward or downward in a controlled repeatable manner without driller intervention. In an exemplary embodiment, this recipe includes entry fields for various movement up or down control parameters such as acceleration, target speed, and move distance in an "Advanced" pop-up box, along with a check box to enable it.

Monitoring the Automatic Bridge Protection parameter 416 prevents the rig crew from damaging the rig equipment and pipe by hitting a bridge in a hole. This parameter 416 measures the static weight of the string and prevents the driller from exceeding the weight of the drill string minus a specific amount. In an exemplary embodiment, the recipe includes an entry field for the bridge detection amount and other related parameters in an "Advanced" pop-up box, along with a check box to enable it.

The on-bottom recipes 418 are another component of most recipes, and include one or more of the operational parameters of Automatic Stalled Mud Motor Detection 420, Automatic Pick-Up 422, Automatic Bail Extension on Kelly Down 424, and Auto Driller Set-Up and Control 426. In various embodiments, each of these operational parameters is included.

Monitoring the Automatic Stalled Mud Motor Detection parameter 420 enables the control system to automatically detect and overcome a stalled downhole mud motor. This parameter 420 measures the Differential Pressure (DP) and determines if the DP reaches the pressure rating of the mud motor. If this occurs, the system will decrease the pump strokes by a certain percentage to re-start the motor. In an exemplary embodiment, the recipe includes entry fields for various motor stall control parameters such as mud motor DP rating and pump stroke back-off percentage in an "Advanced" pop-up box, along with a check box to enable it.

Monitoring the Automatic Pick-Up parameter 422 enables the control system to pick up the drillstring off-bottom in a controlled, repeatable manner without driller intervention. In an exemplary embodiment, the recipe includes entry fields for various lift up control parameters such as pick-up height, pick-up speed, and drill off weight setpoint in an "Advanced" pop-up box, along with a check box to enable it.

Monitoring the Automatic Bail Extension on Kelly Down parameter 424 enables the control system to move the bails into proper position when the "kelly down" position is reached in a controlled, repeatable manner without driller intervention. In an exemplary embodiment, the recipe includes entry fields for various bail extension control parameters such as movement speed in an "Advanced" pop-up box, along with a check box to enable it.

Monitoring the Auto Driller Set-Up and Control parameter 426 enables the control system to perform the process of drilling automatically once the bit is on-bottom. The process can function in three (3) primary control modes: (1) Rate-of-Penetration (ROP), (2) Weight-On-Bit, or (3) Differential Pressure (DP). In an exemplary embodiment, there is a checkbox on the screen for the driller to quickly enable or disable the Auto Driller parameter 426. In some embodiments, the recipe is provided with a Set-Up pop-up box that includes an entry field for selecting the desired mode and fields for entering target values of the control parameters.

Yet another component of most recipes, the pump recipes 428, includes one or more, and typically all, of the Automatic Pump Control parameter 430, Automatic Pressure Control parameter 432, and Pit Volume Total (PVT) Set-Up and Control 434.

Monitoring the Automatic Pump Control parameter 430 enables the control system to monitor and adjust the operation of the mud pumps during each drilling recipe in a controlled, repeatable manner without driller intervention. In an exemplary embodiment, the recipe includes entry fields for various mud pump control parameters such as target strokes in an "Advanced" pop-up box with a check-box to enable it.

Monitoring the Automatic Pressure Control parameter 432 enables the control system to monitor and adjust pump pressure during each drilling recipe in a controlled, repeatable manner without driller intervention. In an exemplary embodiment, the recipe includes entry fields for various pump pressure control parameters such as target pressure and pressure deviation limits in an "Advanced" pop-up box, along with a check-box to enable it.

Monitoring the PVT Set-Up and Control parameter 434 enables the control system to perform the process of mud volume control automatically during drilling. The parameter 434 indicates all aspects of the mud circulation sub-system such as pump rates, pump strokes, total strokes, etc., and can provide a variety of alarms including total volume increase or decrease, excessive mud gas detection, etc. In an exemplary embodiment, the recipe includes entry fields for various PVT parameters such as volume limits, rate deviation limits, and alarm thresholds in an "Advanced" pop-up box, along with a check box to enable it.

Another component of most recipes, the directional drilling recipes 436, includes one or both of the parameters of Automatic Target 438 and Automatic Orientation 440.

Monitoring the Automatic Target parameter 438 enables the control system to monitor and adjust directional drilling targets during each drilling recipe in a controlled, repeatable manner without driller intervention. In an exemplary embodiment, the recipe includes entry fields for various directional drilling target control parameters such as desired inclination, desired azimuth, kick-off point depth, and target angle build date in an "Advanced" pop-up box, along with a check-box to enable it.

Monitoring the Automatic Orientation parameter 440 enables the control system to monitor and adjust directional drilling orientation during each drilling recipe in a controlled, repeatable manner without driller intervention. In an exemplary embodiment, the recipe includes entry fields for various directional drilling parameters such as desired toolface in an "Advanced" pop-up box, along with a checkbox to enable it.

These operational guidelines are directly coupled to the rig control system, and make enforcing best practices on the rig more convenient and scalable for the company man. No longer does the company man need to walk out on the rig floor to teach the operators best practices. The system also extends to tightening and loosening operational alarms and alarm limits.

Use of the present methods and systems results in more effective (i.e., faster, more accurate, and preferably both) taking of corrective operations and a reduction in the frequency and severity of undesirable events. There is less residual down time of the rig, and thus typically more operational time. The methods may run independently of operator input, but may utilize operator overrides. This system caters to operators who recognize that "fast isn't always faster" or sometimes you have to "sometimes be slow to go fast." Downtime or non productive time created by lack of supervision can be minimized by an effective use of well engineered recipes.

The present disclosure relates to a method for controlling operations on a drilling rig. The method includes installing a control system operably coupled to the drilling rig and having a user interface or interfaces; receiving operational guidelines that include a plurality of control limits from the user interface associated with operational parameters of the rig; monitoring current values of the operational parameters; and automatically applying the control limits to the operational parameters during operation of the rig.

The present disclosure further relates to a control system adapted to operate a drilling rig. The control system includes a computer system configured to monitor operational parameters on a rig; an interface engine in communication with the computer system, the interface engine being configured to receive operational guidelines that include a plurality of control limits associated with each of the operational parameters of the rig; a sensor engine in communication with the computer system, the sensor engine being configured to sense the operational parameters used in controlling a well drilling operation; and an operational equipment engine in communication with the computer system, the operational equipment engine being configured to receive input from the computer system to automatically enforce the control limits.

Moreover, the present disclosure relates to a non-transitory computer-readable medium configured to extend a borehole with a rig that includes a plurality of computer-readable instructions which, when executed by one or more processors, are adapted to cause the one or more processors to perform a method. The method includes receiving operational guidelines that include a plurality of control limits associated with operational parameters of the rig from a user interface; monitoring current values of the operational parameters; and automatically applying the control limits to the operational parameters during operation of the rig.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method for controlling operations on a drilling rig, which method comprises:

installing a control system operably coupled to the drilling rig and having a user interface, wherein the control system comprises a computer system;

receiving operational guidelines for a set of specific hole sections from the user interface that include a plurality of control limits associated with operational parameters of the drilling rig, wherein the set of specific hole sections comprises a surface hole, an intermediate hole, a production hole, a ream hole, or a drill production hole, and the control limits are unique to a specific hole section and do not vary within the specific hole section;

determining when a specific hole section of a borehole is reached;

activating one or more of the operational guidelines associated with the specific hole section reached;

monitoring current values of the operational parameters;

determining that a current value of one of the operational parameters is not within the control limits of the specific hole section reached; and automatically adjusting operation of the drilling rig to bring the current value back within the control limits of the specific hole section reached.

2. The method of claim 1, further comprising displaying, with the user interface, the plurality of control limits, current values of the operational parameters, and a plurality of operational limits each associated with an operational parameter.

3. The method of claim 2, wherein the control limits, operational limits, and current values are displayed as a bar graph.

4. The method of claim 1, which further comprises receiving adjusted control limits for a portion of the operational parameters for a different specific hole section.

5. The method of claim 1, which further comprises receiving labels for the operational guidelines.

6. The method of claim 5, wherein the labels are selected to comprise one or more of Drill Surface, Drill Intermediate, Drill Production Hole, Circulate Kick, Run Casing Intermediate, Run Casing Production, Ream Hole, Surface Hole, Intermediate Hole, or Production Hole.

7. The method of claim 1, wherein the operational guidelines comprise:

drawworks guidelines, wherein the drawworks guidelines comprise one or more parameters that measure maximum running speed, an overpull amount, movement of a drillstring upward or downward, or a weight of a drillstring;

on bottom guidelines, wherein the on bottom guidelines comprise one or more parameters that measure differential pressure downhole, movement of bail extensions on a kelly down, or drilling once a bit is on-bottom;

pump guidelines, wherein the pump guidelines comprise one or more parameters that measure operation of mud pumps, pump pressure, or mud volume; and directional drilling guidelines, wherein the directional drilling guidelines comprises one or more parameters that measure directional drilling targets or directional drilling orientation.

8. A control system adapted to operate a drilling rig comprising:

a computer system configured to monitor operational parameters on the drilling rig;

an interface engine in communication with the computer system, the interface engine being configured to receive operational guidelines for a set of specific hole sections that include a plurality of control limits associated with each of the operational parameters of the drilling rig, wherein the set of specific hole sections comprises a surface hole, an intermediate hole, a production hole, a ream hole, or a drill production hole, and the control limits are unique to a specific hole section and do not vary within the specific hole section;

a sensor engine in communication with the computer system, the sensor engine being configured to sense current values of the operational parameters used in controlling a well drilling operation; and an operational equipment engine in communication with the computer system, the operational equipment engine being configured to determine when a specific hole section of a borehole is reached, activate one or more of the operational guidelines associated with the specific hole section reached, alert a rig operator when an operational guideline is activated due to a change in the specific hole section reached, determine that a current value of one of the operational parameters is not within the control limits of the specific hole section reached, and automatically adjust operation of the drilling rig to bring the current value back within the control limits of the specific hole section reached.

9. The control system of claim 8, wherein the interface engine is further configured to display the plurality of control limits, the current values of the operational parameters, and a plurality of operational limits, wherein each of the operational parameters is associated with a respective one of the operational limits.

10. The control system of claim 8, wherein the interface engine is further configured to receive adjusted control limits for a portion of the operational parameters for a different specific hole section.

11. The control system of claim 8, wherein the interface engine is further configured to receive labels for the operational guidelines.

12. The control system of claim 11, wherein the labels are selected to comprise one or more of Drill Surface, Drill Intermediate, Drill Production Hole, Circulate Kick, Run Casing Intermediate, Run Casing Production, Ream Hole, Surface Hole, Intermediate Hole, or Production Hole.

13. The control system of claim 8, wherein the operational guidelines comprise:

drawworks guidelines, wherein the drawworks guidelines comprise one or more parameters that measure maximum running speed, an overpull amount, movement of a drillstring upward or downward, or a weight of a drillstring;

on bottom guidelines, wherein the on bottom guidelines comprise one or more parameters that measure differential pressure downhole, movement of bail extensions on a kelly down, or drilling once a bit is on-bottom;

pump guidelines, wherein the pump guidelines comprise one or more parameters that measure operation of mud pumps, pump pressure, or mud volume; and directional drilling guidelines, wherein the directional drilling guidelines comprise one or more parameters that measure directional drilling targets or directional drilling orientation.

14. The control system of claim 8, wherein the computer system is configured to receive current values of the operational parameters from the sensor engine and compare the current values to the plurality of control limits.

15. A non-transitory computer-readable medium configured to extend a borehole with a drilling rig comprising a plurality of computer-readable instructions which, when executed by one or more processors, are adapted to cause the one or more processors to perform a method comprising:

receiving operational guidelines for a set of specific hole sections from a user interface that include a plurality of control limits associated with operational parameters of the drilling rig wherein the set of specific hole sections comprises a surface hole, an intermediate hole, a production hole, a ream hole, or a drill production hole, and the control limits are unique to a specific hole section and do not vary within the specific hole section;

determining when a specific hole section of a borehole is reached;

activating one or more of the operational guidelines associated with the specific hole section reached;

alerting a rig operator when an operational guideline is activated due to a change in the specific hole section reached;

monitoring current values of the operational parameters;

determining that a current value of one of the operational parameters is not within the control limits of the specific hole section reached; and automatically adjusting operation of the drilling rig to bring the current value back within the control limits of the specific hole section reached.

16. The non-transitory computer-readable medium of claim 15, wherein the method further comprises displaying the control limits, the current values of the operation parameters, and a plurality of operational limits, wherein each of the operational parameters is associated with a respective one of the operational limits.

17. The non-transitory computer-readable medium of claim 15, wherein the method further comprises receiving adjusted control limits for a portion of the operational parameters for a different specific hole section.

18. The non-transitory computer-readable medium of claim 15, wherein the method further comprises receiving the current values of the operational parameters and comparing the current values to the plurality of control limits.

* * * * *